United States Patent [19]

Ueno et al.

[11] 4,344,297

[45] Aug. 17, 1982

[54] REFRIGERATION SYSTEM

[75] Inventors: Fumito Ueno, Shiga; Kunio Fukuhara, Kusatsu, both of Japan

[73] Assignee: Daikin Kogyo Co., Ltd., Osaka, Japan

[21] Appl. No.: 246,857

[22] Filed: Mar. 23, 1981

[30] Foreign Application Priority Data

Mar. 20, 1980 [JP] Japan ..... 55-41044
Mar. 12, 1981 [JP] Japan ..... 56-36207

[51] Int. Cl.[3] ..... F25B 41/00

[52] U.S. Cl. ..... 62/196 C; 62/228; 236/80 R; 417/299

[58] Field of Search ..... 62/196 C, 117, 228 C; 236/80 R; 417/299, 440, 290

[56] References Cited

U.S. PATENT DOCUMENTS 2,299,811 10/1942 Feicht ..... 62/227 X
2,920,812 1/1960 Courtney, Jr. ..... 62/228 C
3,759,057 9/1973 English et al. ..... 62/196 C

*Primary Examiner*—William E. Wayner
*Attorney, Agent, or Firm*—Stevens, Davis, Miller & Mosher

[57] ABSTRACT

A refrigeration system provided with a rotary compressor, a refrigeration pipe line system connected with the compressor and having a gas-liquid separator for separating an injection pressure gas refrigerant, and a gas injection channel extending from a gas zone of the separator and having an open-close valve. The compressor is provided at its cylinder block with an injection pressure port opening to a pumping chamber and with a valve chamber communicating with the port. A by-pass passage channel communicating with the suction port side of the chamber extends from the valve chamber, and a control valve having a communication aperture and a spring, are housed within the valve chamber, the injection channel is connected with a back chamber of the control valve within the valve chamber, so that the open-close valve may be operated to control a capacity of the refrigeration system.

3 Claims, 13 Drawing Figures

REFRIGERATION SYSTEM

FIELD OF THE INVENTION

This invention relates to refrigeration systems for air-cooling or air-cooling and -heating, and more particularly to a refrigeration system which is provided with a compressor controlled in its capacity to perform refrigeration corresponding to an aircooling or -heating load.

BACKGROUND OF THE INVENTION

Conventionally, a refrigeration system, as proposed in U.S. Pat. No. 2,299,811, is well-known, which is so constructed that a rotary compressor is used which has a cylinder having a suction port and discharge port, with an injection pressure port opening at a pumping chamber between the ports. A refrigeration pipe line system connecting the suction port and discharge port is provided with a heat exchanger, two-divided expansion mechanisms, and a gas-liquid separator interposed at an intermediate portion between the expansion mechanism. A gas injection passage tube connects with a gas zone of the gas-liquid separator and communicates with the injection pressure port so that an injection pressure gas refrigerant separated by the gas-liquid separator is injected into the pumping chamber at the cylinder to increase the capacity of the compressor above the rated capacity to thereby achieve a capacity increases for the refrigeration system.

Another refrigeration system has been proposed, which is provided with a by-pass passage channel through which the injection pressure port communicates with the suction port at the previously described compressor, and solenoid open-close valves are provided at the by-pass passage channel and injection passage channel respectively, so that each valve is switched to inject the injection pressure gas refrigerant separated by the gas-liquid separator, from the injection pressure port into the pumping chamber, thereby raising the capacity of the refrigeration system alternatively, a part of the gas refrigerant taken up from the suction port to the pumping chamber is by-passed toward the suction port, so that the effective volume of the pumping chamber is reduced, thereby reducing the refrigeration system capacity.

The refrigeration system switches the open-close valve to enable a desirably selective decrease or increase in capacity. The injection pressure port is used in both cases for injecting an injection pressure gas refrigerant and for by-passing a part of the drawn-in gas refrigerant. Also, the diameter of the port is not changed for the injection and by-passing. The flow rate of gas refrigerant passing through the port depends upon its diameter.

Therefore, the diameter of the injection pressure port is set in consideration of a relationship between the injection mass flow of gas refrigerant necessary for an increase in capacity and the by-pass mass flow necessary for a decrease in capacity, and they are not changeable without hingering each other.

In other words, when the passing capacity for an injection pressure gas passing through the injection pressure port is larger than a generating mass flow of an injection pressure gas refrigerant provided by the gas-liquid separator, the gas refrigerant for injection becomes mixed with a liquid refrigerant. If the injection pressure port has a diameter sufficient to permit the aforesaid injection pressure gas to pass at a smaller level than the level of the generating mass flow of gas refrigerant, the problem of mixing the liquid refrigerant will be corrected. On the other hand, the smaller diameter of the injection pressure port increases the resistance against the gas refrigerant by-passed from the pumping chamber toward the suction port side, thereby creating the problem that a desired mass flow of gas refrigerant is not obtainable during by-pass.

In addition, the diameter of the injection pressure port, when made large enough to get the by-pass mass flow necessary for a decrease in capacity, will of course cause a drawing in of the liquid refrigerant during the injection.

The above problems may be solved by forming the diameter of the port large enough to obtain the by-pass mass flow necessary for the decrease in capacity, and providing a resistance passage, such as a capillary tube, at the injection passage channel. This, however, makes the injection passage channel complex in construction and also expensive to produce, whereby this remedy is not satisfactory.

When the compressor is restarted after being stopped, if the high pressure and low pressure at the suction port and discharge port sides are not equalized, an increased starting torque is required for restarting. The restarting generally is carried out after equalizing the pressure.

Since a discharge valve is provided at the discharge port to isolate the suction port side from the discharge port side, the aforesaid pressure equalizing takes time, e.g., about five minutes.

The pressure equalizing generally hastened by a pressure equalizing conduit provided between the high pressure pipe line and the low pressure line and having a solenoid operated openclose valve. The valve is open when operation of the compressor halts.

In the aforesaid refrigeration system, a solenoid valve at the by-pass passage channel is closed and that at the injection passage channel is open to enable the pressure equalizing, requiring a complicated control device for operating the two solenoid valves. On the other hand, the compressor, when starting, can relieve a starting load by a decreasing of capacity for reducing its work load. In this instance, opposite to the pressure equalizing, the solenoid valve at the by-pass passage channel should be open and that at the injection passage channel is closed, thus further complicating the control device.

SUMMARY OF THE INVENTION

This invention has been designed to overcome the aforesaid problems. A main object of the invention is to provide a refrigeration system which can desirably set an injection mass flow of a refrigerant necessary for an increase in capacity and a by-pass mass flow for a decrease in capacity in the optimum amount without interferring with each other, and without liquidcompression during the injection and no deterioration in efficiency caused by the resistance against passing of a refrigerant during the by-passing, whereby the system performs a desirable capacity control. Another object of the invention is to provide a refrigeration system which avoids the use of a complicated control device for easy pressure equalizing between high pressure and low pressure during a halt in operation of the compressor and also for an easy capacity reduction operation for a fixed time when the compressor starts to thereby reduce a work load and relieve a starting load.

A refrigeration system of the invention is provided with; a cylinder block having a cylinder chamber, a suction port and a discharge port which are open at the cylinder chamber, and an injection pressure port opening at a pumping chamber between the suction port and the discharge port; a rotary compressor having a rotor rotating within the cylinder chamber; a refrigeration pipe line system connecting with the suction port and discharge port of the compressor and having heat exchangers, two-divided expansion mechanisms, and a gas-liquid separator provided at an intermediate position between the expansion mechanisms; and an injection passage channel extending from a gas zone at the gasliquid separator and communicating with the injection pressure port and having an open-close valve. The refrigeration system includes the following constitution features in order to control the capacity of the compressor and perform capacity control of the system.

The cylinder block provides a valve chamber communicating with the injection pressure port. A by-pass passage channel communicating with the suction port side connects with the valve chamber, and the valve chamber is provided with a control valve which opens or closes the injection pressure port and a by-pass passage channel. A spring normally keeps the control valve open, the control valve being provided with a communicating aperture through which a back chamber of the control valve communicates with the injection pressure port and gas injection is carried out. The back chamber communicates with the injection passage channel. The gas-liquid separator is interposed with respect to the expansion mechanisms at a position where a generating mass flow of the injection pressure gas given off by the gas-liquid separator is somewhat larger than an injection mass flow of the gas injection into the pumping chamber for a capacity increase, and the communicating aperture is formed to have a diameter by which a passing capacity of the injection pressure gas passing through the aperture is made smaller than the generating mass flow of the gas given off by the separator.

The diameter of the communicating aperture at the control valve can independently set an injection mass flow of the injection pressure gas, and the diameter of the injection pressure port can set a by-pass mass flow, whereby the injection mass flows sufficient for the increase capacity and decrease capacity, can be desirably set. Moreover, during the injection of the injection pressure gas, no liquid refrigerant is drawn-in to cause the liquid suction, and during the by-passing, no deterioration of the efficiency is caused by an increase in the resistance against passing of the gas refrigerant.

Furthermore, since the control valve has the communicating aperture and the back chamber of the valve communicates with the injection passage channel, the pressure of the injection pressure gas can open or close the control valve. Therefore, only one open-close valve, which is provided at the injection passage channel, is controlled to enable a simplification of the pressure equalizing control for performing the pressure equalizing of the high pressure and low pressure when the operation of the compressor is halted, and of the operation control thereof for relieving the starting load when the compressor starts.

In addition, the rotary compressor in this invention includes a stationary blade type rotary compressor which supports at the cylinder one blade having a sealing surface in contact with the rotor, and a rotary blade type rotary compressor which supports at the rotor a pair of blades each having a sealing surface in contact with the inner periphery of the cylinder.

These and other objects, features and advantages of the invention will become more apparent upon a reading of the following detailed specification and drawings, in which:

BRIEF DESCRIPTION OF THE INVENTION

FIG. 1 is a typical schematic view explanatory of an embodiment of a refrigeration system of the invention, FIG. 2 is a bottom view of a compressor used in the refrigeration system in FIG. 1, from which a housing bottom is removed, FIG. 3 is a sectional view taken on the line A-B-C-D-E in FIG. 2, in which the housing bottom is attached to the compressor in FIG. 2, FIG. 4 is a partially omitted sectional view taken on the line A-R-P-D-N in FIG. 2, FIG. 5 is a sectional view taken on the line F-G in FIG. 3, FIG. 6 is a sectional view taken on the line H-J in FIG. 3, in which a motor stator is omitted and a part of a muffler is cutaway, FIG. 7 through 10 are views explanatory of a suction-compression process of the compressor, FIG. 11 is a schematic view explanatory of a modified embodiment of the compressor, corresponding to FIG. 7, FIG. 12 is a schematic connection diagram explanatory of a modified embodiment of a connecting portion of an expansion mechanism and gas-liquid separator, and FIG. 13 is a Mollier chart of function of the refrigeration system of the invention.

DETAILED DESCRIPTION OF THE INVENTION

Figure 1:
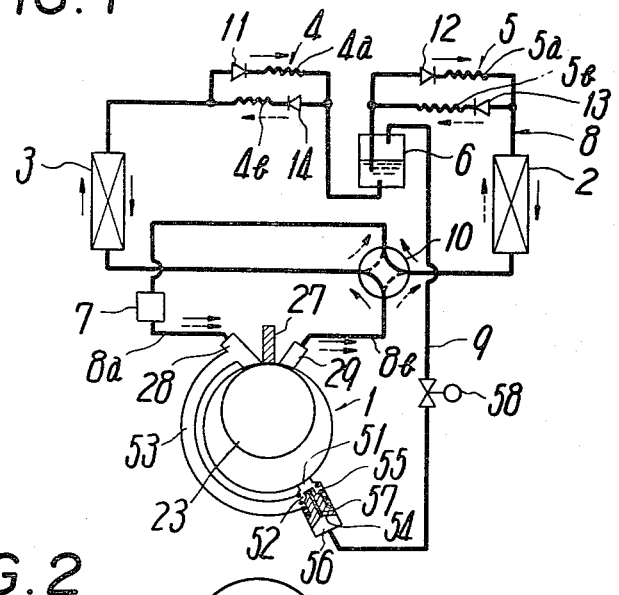
Figure 2:
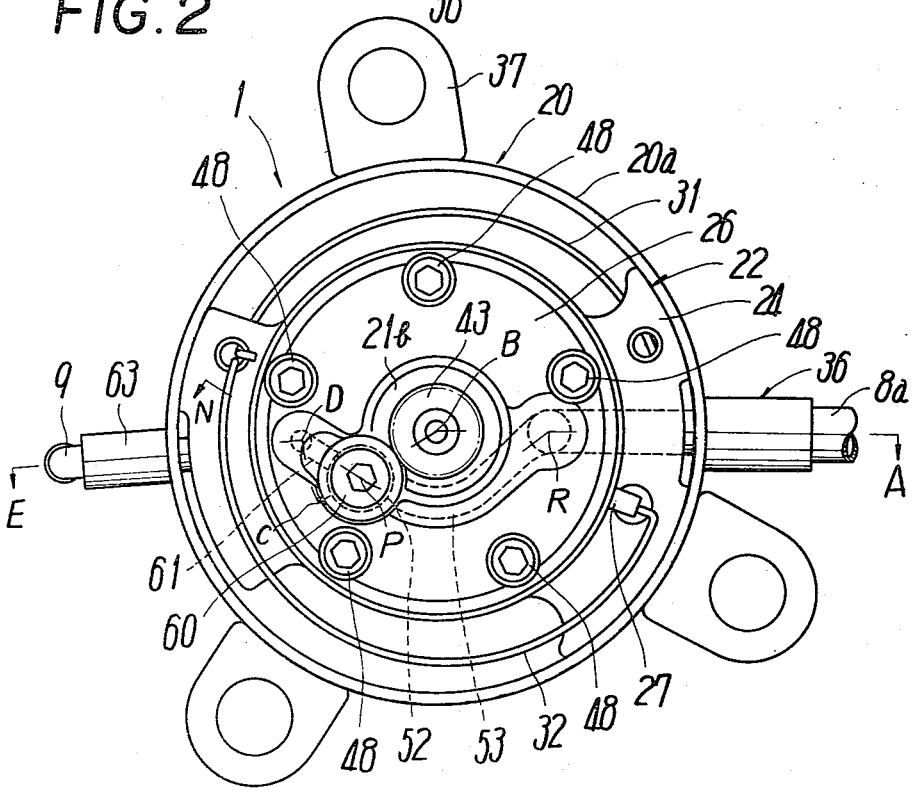

A refrigeration system of the invention is basically constructed as shown in FIG. 1, and provided with a rotary type compressor. A refrigeration pipe line system 8 is connected thereto having two heat exchangers 2 and 3, two-divided expansion mechanisms 4 and 5, a gas-liquid separator 6 provided at an intermediate position between the expansion mechanisms 4 and 5, an accumulator 7; and a gas injection passage channel 9 extending from a gas zone at the separator 6 and connecting with the compressor 1. A capacity control mechanism to be hereinafter described is incorporated in the compressor 1, so that an injection pressure gas refrigerant separated from the gas-liquid separator 6 is injected from the injection passage channel 9 to the pumping chamber at the compressor 1 by way of the control mechanism, thereby performing an increase in capacity. A part of the gas refrigerant sucked into the pumping chamber is by-passed toward the suction side through the by-pass passage channel constituting the capacity control mechanism, thereby reducing capacity.

Referring to FIG. 1, the refrigeration pipe line system 8 is provided with a four-way reversing valve 10, which is changed over to form a cooling cycle shown by the solid arrow line in FIG. 1 and a heating cycle by the dotted arrow line, so that the indoor heat exchanger 2 among the heat exchangers 2 and 3 is used as an evaporator in the cooling cycle and as a condenser in the heating cycle. The expansion mechanisms 4 and 5 comprise capillary tubes 4*a* and 5*a* working during the cooling cycle and like tubes 4*b* and 5*b* working during the heating cycle. The capillary tubes 4*a*, 5*a*, 4*b* and 5*B* are connected with the gas-liquid separator 6 in such a manner that the capillary tubes 4*a* and 5*a* working for the cooling cycle and those 4*b* and 5*b* for the heating cycle are arranged in parallel respectively and then joined to be connected to a liquid zone of the separator 6 as shown in FIG. 1. Alternatively, the respective capillary tubes 4*a*, 5*b*,5*a* and 4*b* may be connected in series, so that an intermediate portion between the tubes 4*a* and 5*b* and that between the tubes 4*b* and 5*a* may be connected to the separator 6.

In addition, the heat exchanger 3, provided outdoors of course, functions as a condenser during the cooling cycle and as an evaporator during the heating cycle. The capillary tubes 4*a*, 5*a*, 4*b* and 5*b* connect in series with check valves 11, 12, 13 and 14 respectively.

In the aforesaid construction, the capillary tube 4*a* or 5*b* at the upstream side of the gas-liquid separator 6 is adjusted in length with respect to the capillary tube 5*a* or 4*b* at the downstream side, so that a refrigerant pressure within the gas-liquid separator 6 is defined to enable adjustment of a generating mass flow of the injection pressure gas given off from the gas-liquid separator 6.

The compressor 1, as shown in FIGS. 2 through 6, has an enclosed-type housing 20 comprising a cylindrical housing body 20*a*, a housing top 20*b* and a housing bottom 20*c*, the housing 20 housing therein; a motor 21 comprising a rotor 21*a*, a drive shaft 21*b* and a stator 21*c*; and a cylinder block 22 to be hereinafter described. The drive shaft 21*b* is fixed to the rotor 21*a* and projects through the cylinder block 22, thereby driving a rotor 23 housed within the cylinder block 22. The cylinder block 22 comprises; a cylinder body 24 provided at the central portion thereof with a cylinder chamber 24*a* having a round wall concentric with the axis of drive shaft 21*b*; and a front head 25 and a rear head 26, which have flat surfaces to close the cylinder chamber 24*a*; the cylinder chamber housing therein the rotor 23 rotatable eccentrically with respect to the axis of drive shaft 21*b*.

The compressor 1 shown in FIGS. 2 through 6 is a stationary blade type rotary compressor. The rotor 23 comprises a cam 23*a* extending integrally from the drive shaft 21*b* and having a round outer periphery, and a roller 23*b* fitted onto the outer periphery of cam 23*a*. The center of cam 23*a* is shifted from the axis of drive shaft 21*b*, and in turn the center of cylinder chamber 24*a*. The roller 23*b* has an axial length substantially equal to a height of cylinder chamber 24*a*, in turn a length between the flat surfaces of the front and rear heads 25 and 26, and line-contacts at the outer periphery with the inner periphery of the cylinder wall, so that the drive shaft 21*b* is driven and the contact point $O_1$ of the roller 23*b* with the cylinder wall moves circumferentially along the cylinder wall.

A blade 27 having a sealing surface in close contact with the outer periphery of roller 23*b* is mounted on the cylinder body 24, a suction port 28 and a discharge port 29 open at the cylinder chamber 24*a*, are provided at both widthwise sides of blade 27 and in proximity thereto, and between the suction port 28 and the discharge port 29 is formed a pumping chamber 30 partitioned by the contact point $O_1$ of roller 23*b* against the cylinder wall and by that $O_2$ of the blade 27 against the outer periphery of the roller 23*b*. The blade 27 has a width equal to an axial length of the roller 23*b*, is supported slidably within a guide groove formed at the cylinder body 24, and is biased, by a pair of blade mounting springs 31 and 32 supported at one ends thereof to the cylinder body 24, to enter the cylinder chamber 24*a* and always contact at the sealing surface of blade 27 with the outer periphery of roller 23*b*.

The suction port 28 is provided at one side of the cylinder body 24 to horizontally project through the cylinder wall. The discharge port 29 is provided at the front head 25 to perforate vertically through the flat surface thereof, and has at its opening on the enclosed housing 20 a discharge valve 33 supported to the front head 25.

The suction port 28 carries an assembly of connection tubes 34 and 35 through a joint pipe 36, the connection tube 35 connecting with the low pressure side, i.e., a suction pipe 8*a* extending from the outlet of the accumulator 7. The discharge port 29 is open at the housing 20 through the discharge valve 33, so that a gas refrigerant is discharged from the discharge port 29 toward a discharge pipe 8*b* of the refrigeration pipe line system 8 connected with the housing top 20*b*.

In addition, in FIGS. 2 through 6, reference numeral 37 designates a bracket member, 38 designates terminals for feeding power to the stator 21*c* of motor 21, 39 designates a terminal guard, 40 designates a terminal cover, 41 designates a balance weight fixed to the rotor 21*a* at the motor 21, 42 designates a magnet mounted on the housing bottom 20*c* and for removing iron powder or the like mixed in lubricating oil filled at the bottom of the housing 20, and 43 designates an oil pump which is mounted on the lower end of the drive shaft 21*b* and discharges the lubricating oil into an oil passage channel 44 provided at the center of drive shaft 21*b*. The oil passage channel 44 has an oil supply conduit 44*a* through which the lubricating oil is supplied to the oil chambers 23*c* provided at both vertical sides of the cam 23*a* constituting the rotor 23, and an oil supply conduit 44*b* for supplying the lubricating oil between the front head 25 and rear head 26 and the drive shaft 21*b*.

Also, reference numeral 45 designates a muffler covering the upper portion of the front head 25 to reduce noise generated by a discharge of the refrigerant from the discharge port 29, 46 designates mounting bolts to mount the muffler 45 and front head 25 on the cylinder body 24, 47 designates mounting bolts to mount the front head 25 on the cylinder body 24, and 48 designates mounting bolts to mount the rear head 26 on the cylinder body 24.

The aforesaid construction of the compressor 1 is well-known, and will be understood without a further detailed description.

The refrigeration system shown in the drawings has the following capacity control mechanism incorporated in compressor 1.

The capacity control mechanism comprises an injection pressure port 51 provided at cylinder block 22 and open at the pumping chamber 30, a valve chamber 52 communicating with the injection pressure port 51, and a by-pass passage channel 53 extending from the valve chamber 52 toward or the vicinity of the suction port 28 and being open thereat; the valve chamber 52 houses therein a control valve 54 for opening or closing the injection pressure port 51 and by-pass passage channel 53, and a spring 55 biasing the control valve 54 to be always open. The the control valve 54 is provided with a communicating aperture 57 through which the back chamber 56 of the control valve 54 communicates with the injection pressure port 51, so that the injection pressure gas refrigerant is injected therefrom into the pumping chamber 30. Also, the injection passage channel 9 communicates with the back chamber 56, and is insertably provided with an open-close valve 58 (FIG. 1) mainly comprising a solenoid valve. The gas-liquid separator 6 is interposed with respect to the expansion mechanisms 4 and 5 at the position where a generating mass flow of the injection pressure gas refrigerant given off from the gas-liquid separator 6 is somewhat larger than an injection mass flow of the gas refrigerant injected into the pumping chamber 30 for an increase in capacity. A diameter of the communicating aperture 57 is formed to make a passing capacity of the injection pressure gas refrigerant passing through the aperture 57 smaller than the generation mass flow of the gas refrigerant at the gas-liquid separator 6.

Figure 3:
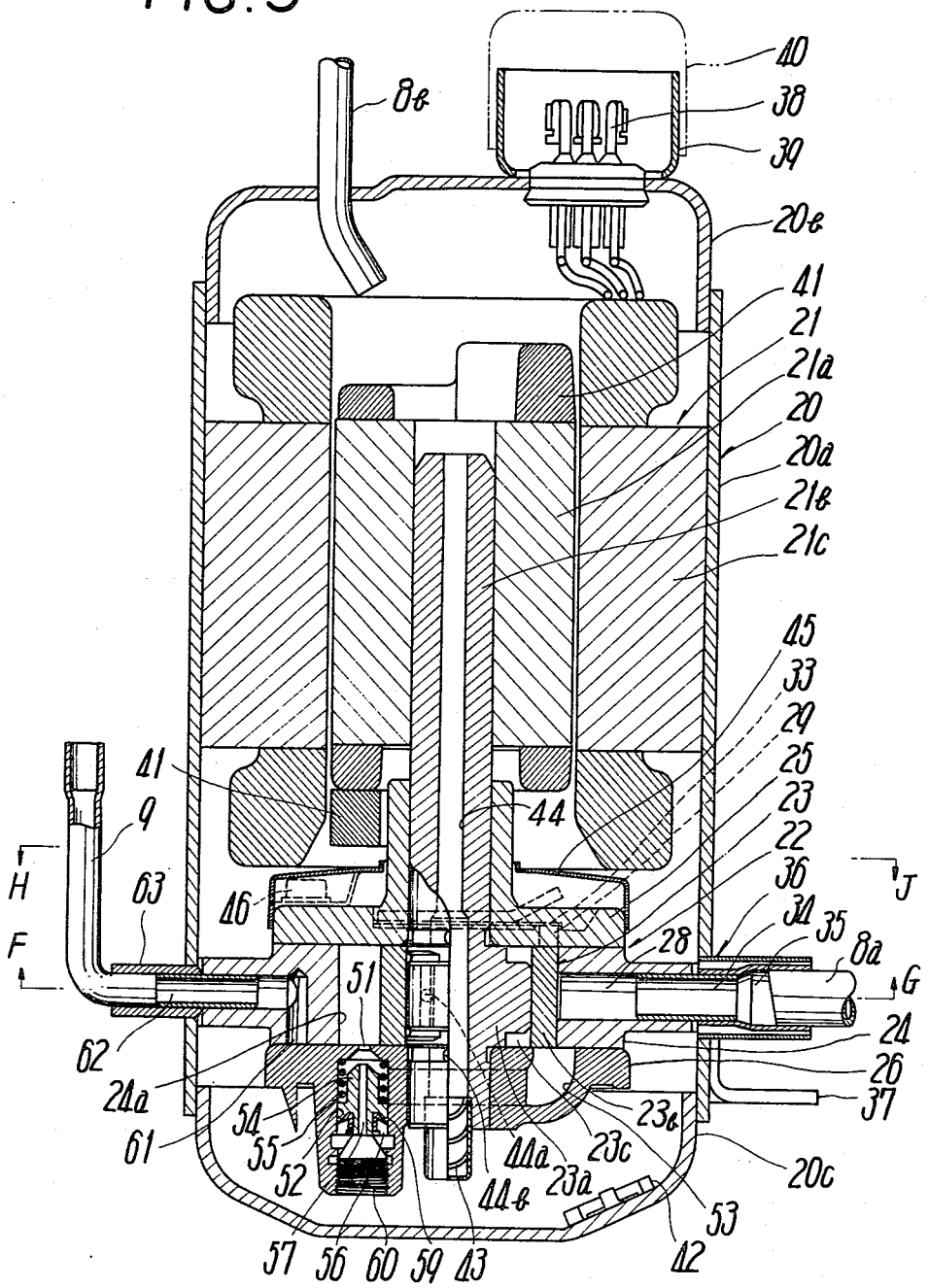
Figure 4:
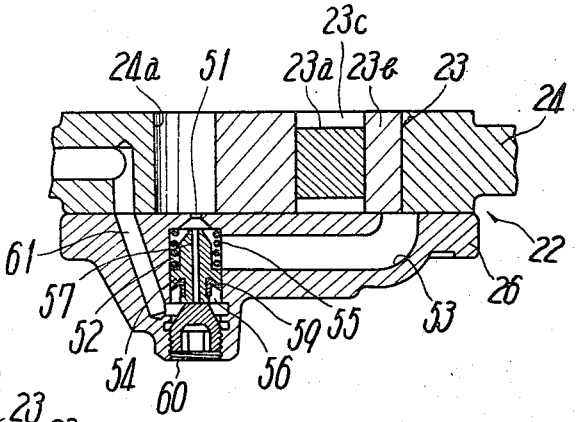
Figure 5:
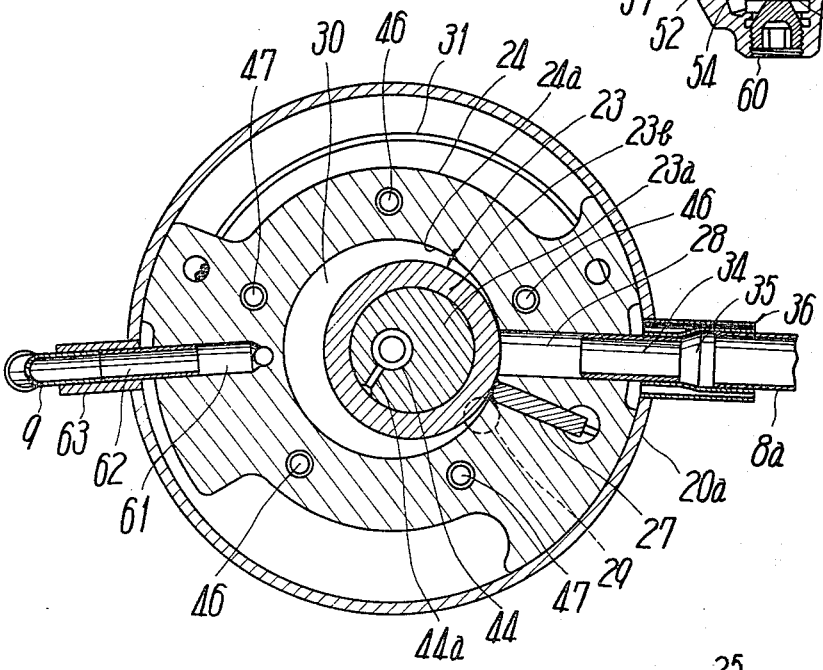
Figure 6:
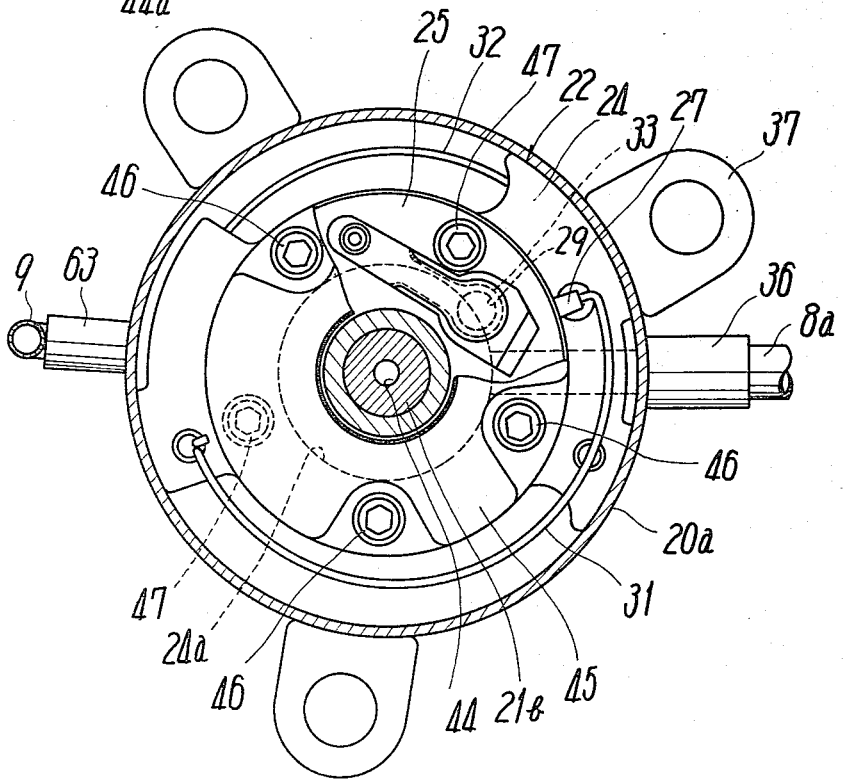

In the aforesaid construction, the control valve 54 is housed movably in the valve chamber 52 and mainly employs a finger valve type valve as shown in FIGS. 3 and 4. The control valve 54 receives the spring 55 by a flange formed at the lower portion of the valve 54, and a sealing material 59 is provided at the lower surface of the flange, so that the back chamber 56 is formed between the sealing material 59 and a blind lid 60 screwable with the lower end of the valve chamber 52. The injection pressure gas refrigerant, when introduced into the back chamber 56, flows into the pumping chamber 30 through the communicating aperture 57 to create a differential pressure before and behind the control valve 54, so that the control valve 54 moves toward the injection pressure port 51 to thereby shut off the injection pressure port 51 from the valve chamber 52, and in turn the by-pass passage channel 53, by use of the conical sealing surface at the top of control valve 54. Hence, the injection pressure gas refrigerant can be injected from the aperture 57 into the pumping chamber 30. When no gas refrigerant is introduced into the back chamber 56, the pressure is equalized before and behind the control valve 54 by way of the communicating aperture 57, so that the spring 55 functions to move the control valve 54 away from the injection pressure port 51, and the by-pass passage channel 53 communicates with the injection pressure port 51 through the valve chamber 52. Hence, a part of the gas refrigerant within the pumping chamber 30 can be by-passed, following the revolution of the rotor 23, toward the suction port 28 from the injection pressure port 51 by way of the valve chamber 52 and by-pass passage channel 53.

As seen from the above, the injection occurs through the communicating aperture 57, and the by-passing occurs through the injection pressure port 51. In other words, the injection is carried out regardless of a diameter of the injection pressure port 51, and the by-passing is done regardless of the communicating aperture 57, so that the diameter of the injection pressure port 51 is set to be long enough to obtain the maximum efficiency for the by-passing. In brief, the injection mass flow and by-pass mass flow of the gas refrigerant can independently be set. Therefore, the injection mass flow necessary for the capacity increase and by-pass mass flow necessary for the capacity decrease, can be made the most moderate, thereby creating no problem of the liquid refrigerant being sucked into the pumping chamber 30 during the injection, and of poor efficiency during the by-passing.

A sectional area of the by-pass passage channel 53 and of a portion including the injection pressure port 51, valve chamber 52 and by-pass passage channel 53, is made larger than the size of the communicating aperture 57. Namely, when a diameter of the aperture 57 is about 1.8 mm, that of the injection pressure port 51 is preferably about 2.8 mm.

The back chamber 56 communicates with the injection passage channel 9 in such a manner that an apparatus pipe 61, as shown in FIGS. 3 and 4, is provided through the cylinder body 24 and rear head 26. The lower end of the apparatus pipe 61 is open at the back chamber 56 and the upper end of the same is open at the lateral side of the cylinder body 24, so that a connection pipe 62 projecting through the housing body **20*a* is mounted on the opening at the cylinder body 24, the connection pipe 62 connecting with the injection passage channel 9 through a joint pipe 63**.

The injection pressure port 51 is provided mainly at the rear head 26 as shown, or at the front head 25 (not shown) and is oriented to be perpendicular with respect to the flat surface of the head 26 or 25. The valve chamber 52 communicating with the injection pressure port 51 is provided in alignment with the injection pressure port 51. The by-pass passage channel 53 communicates with the valve chamber 52 at a intermediate portion thereof and at a right angle with the longitudinal direction of the same.

In addition, the injection pressure port 51 and discharge port 29 shown in FIG. 1, are open at the lateral side of the cylinder chamber **24*a*, which is shown in schematic form for quick understanding, but the port 51 essentially is provided at a right angle with the flat surface of the head 26 or 25**.

Next, the position where the injection pressure port 51 is formed, will be detailed.

In the compressor 1, one discharge is carried out once at each rotation of the rotor 23. When viewed from one pumping chamber 30, the rotor 23, as shown in FIGS. 7 through 10, twice rotates to perform one discharge.

Figure 7:
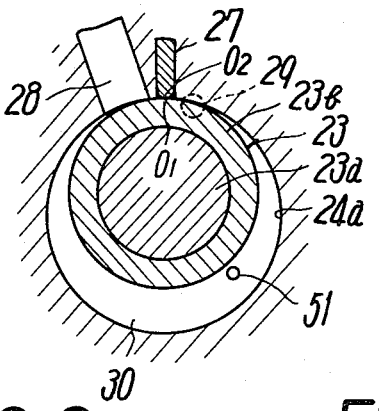
Figure 9:
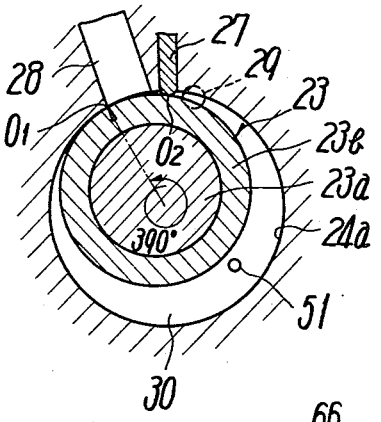

In other words, when the contact point $O_1$ of the rotor 23 against the cylinder wall coincides in position with the contact point $O_2$ of the blade 27 against the rotor 23 as shown in FIG. 7, this coincident angular position is made to be the base point in which a volume of the pumping chamber 30 is zero. After the contact point $O_1$ enters into the opening of suction port 28, the volume of the pumping chamber 30 increases to draw therein the gas refrigerant through the suction port 28. The rotor 23, as shown in FIG. 9, then rotates to an angle of 390° from the base point, at which point the contact point $O_1$ passes through the suction port 28, thus ending the suction. At this time the pumping chamber 30 is the largest in volume. Thereafter, the rotor 23 rotates to decrease the volume of the pumping chamber 30 and compresses the gas refrigerant drawn therein, and at the angular position where the rotor 23 rotates, for example, to an angle of 585° with respect to the base point, the discharge valve 33 opens to start a discharge of the compressed gas refrigerant under high pressure, and when the contact point $O_1$ returns to the position shown in FIG. 7, that is, when the rotor 23 rotates at an angle of 720° from the base point, the discharge is over.

In compressor 1 operating as the above, the injection pressure port 51 is open or closed by the eccentrically rotating rotor 23. The position of the injection pressure port 51 is so determined that at first in a compression process, the position is before an angular position of the rotor 23 wherein the discharge valve 33 opens, in a range in which the pressure in the pumping chamber 30 is less than that in the gas-liquid separator 6, and wherein the rotor 23 closes the injection pressure port 51. Since the rotor 23 is formed of the cam 23*a* and roller 23*b* and is supplied with high pressure lubricating oil from the oil chamber 23*c* therebetween, the port 51 is adapted to be positioned radially outwardly from a phantom circle drawn around the axis of the drive shaft 21*b* by a radius extending therefrom to the inner periphery of the roller 23*b* on the line connecting said axis and contact point $O_1$.

Figure 8:
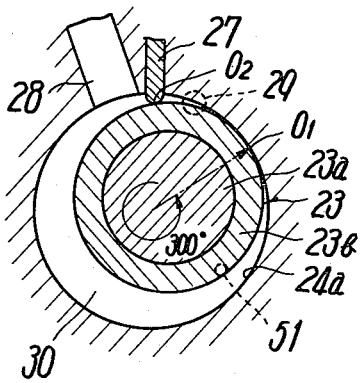
Figure 10:
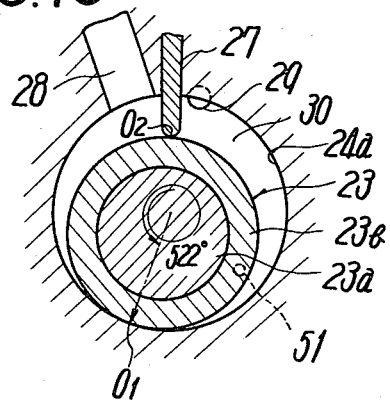

Furthermore, in the suction process, an angle in a range between an angular position just before the rotor 23 begins to open the injection pressure port 51, in other words, an angular position where the contact point $O_1$ rotates by an angle of 300° with respect to the base point as shown in FIG. 8, and an angular position (at 390°) where the suction process is over, as shown in FIG. 9, is assumed to be a return angle. An angular range between an angular position where the suction process is over and the angular position where the rotor 23, during the compression process, closes the injection pressure port 51, that is, the angular position before discharge valve 33 is open and where the contact point $O_1$ rotates at an angle of 522° with respect to the point as shown in FIG. 10, is assumed to be an injection angle. In this case, the port 51 is set at the position where the injection angle is larger than the return angle. In addition, in FIGS. 8 through 10, the return angle is 90° and the injection angle is 132°.

Also, the injection pressure port 51 is open at the pumping chamber 30 while the rotor 23 is in a range of the return angle and injection angle. When the injection pressure gas refrigerant is injected, the injection begins at the initial position of the return angle in the suction process and ends at the terminal position of the injection angle. When the rotor 23 is positioned within the range of the return angle, the suction port 28 together with the injection pressure port 51 is open at the pumping chamber 30, so that the infected gas refrigerant allows the gas refrigerant in suction to decrease, but a suction mass flow into the pumping chamber 30 does not decrease in itself. The injection in this range has no effect of the capacity increase, whereby it is preferred to make smaller the return angle.

The rotor 23 passes through the return angle to end the suction process and enters into the injection angle to begin the compression process. During the presence of rotor 23 within the injection angle, the injection pressure port 51 only opens at the pumping chamber 30, so that the injection mass flow of the injection pressure gas refrigerant injected from the communication aperture 57 through the injection pressure port 51 is added to a gas mass flow filling the pumping chamber 30, thereby increasing a capacity of the compressor 1 to promote the capacity-increase.

As a result, the injection angle and diameter of the communication aperture 57 will determine the injection mass flow to promote the capacity increase.

On the other hand, when the by-pass passage channel 53 is open to perform the capacity decrease, the gas refrigerant, as the same as the above, is sucked merely through the suction port 28 and injection pressure port 51 within the return angle in which the ports 28 and 51 and open at the pumping chamber 30, thereby causing no reduction in capacity.

Next, when the rotor 23, enters into the injection angle, the injection pressure port 51 only opens at the pumping chamber 30, and the volume thereof decreases following rotation of the rotor 23, whereby a gas refrigerant of a flow to meet with the volume decrease is by-passed through the by-pass passage channel 53. Hence, the gas refrigerant filling in pumping chamber 30 is hardly compressed, the gas refrigerant being compressed only at the compression process after passing through the injection angle, in turn, a finish of the by-passing, and then discharged through the discharge port 29, thereby reducing the capacity of the compressor 1 to an extent only of a volume corresponding to the injection angle, thus causing a capacity decrease.

As a result, the injection angle and diameter of the injection pressure port 51 will determined a by-pass mass flow of the gas refrigerant for the capacity decrease.

In addition, the diameter of injection pressure port 51 affects the return and injection angles, whereby it is necessary to define the injection angle in consideration of the diameter of the port 51.

The operation of the refrigeration system constructed as foregoing will now be described.

The control for capacity increase and capacity decrease is performed only by opening or closing one open-close valve 58 interposed within the injection passage channel 9. When the valve 58 is open, the injection pressure gas refrigerant separated by the gas-liquid separator 6 is introduced into the back chamber 56 of the control valve 54 to close the by-pass passage channel 53 as abovementioned, so that the injection pressure gas refrigerant is injected into the pumping chamber 30 through the communication aperture 57 at the control valve 54, thereby performing the capacity increase. On the other hand, when the open-close valve 58 is closed, no gas refrigerant is introduced into the back chamber 56, so that the back chamber 56 and injection pressure port 51 communicating therewith through the aperture 57, are equalized in pressure and the spring 55 acts to open the control valve 54. Hence, the by-pass channel 53 communicates with the pumping chamber 30 by way of the injection pressure port 51, whereby the gas refrigerant within the pumping chamber 30 is by-passed into the by-pass passage channel 53 to enable a capacity decrease.

Figure 13:
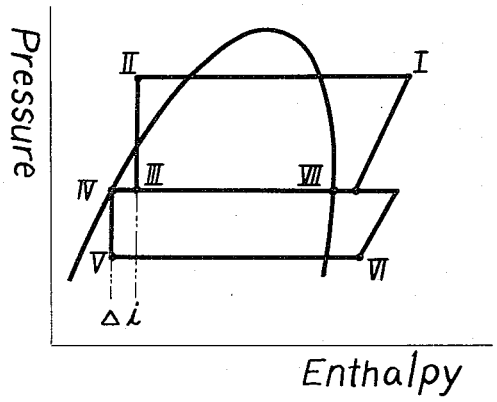

Next, the capacity increase by injection of the injection pressure gas refrigerant will be described in accordance with the Mollier chart in FIG. 13.

In the drawing, reference numerals I through VII designate refrigeration cycles, in which I designates a high pressure gas refrigerant discharged from the discharge port 29 at the compressor 1, II designates a high pressure liquid refrigerant at the outlet side of the heat exchanger 2 or 3 serving as the condenser, III designates a liquid-gas mixture refrigerant lowered to injection pressure by the expansion mechanism 4 or 5 at the upstream side, IV designates an injection pressure liquid refrigerant separated by the gas-liquid separator 6, V designates a liquid-gas mixture refrigerant lowered to low pressure by the expansion mechanism 5 or 4 at the downstream side, VI designates a condition of the low pressure gas refrigerant sucked from the suction port 28 of the compressor 1 at the outlet side of the heat exchanger 3 or 2 serving as an evaporator, and VII designates an injection pressure gas refrigerant separated by the gas-liquid separator 6.

During injection, the injection pressure gas refrigerant VII separated by the gas-liquid separator 6 is injected into the pumping chamber 30, so that when the injection mass flow is expressed by g, and a circulating mass flow of the refrigerants IV, V and VI, which return from the gas-liquid separator 6 to the suction port 28 at the compressor 1 through the expansion mechanism 5 or 4 at the downstream side and heat exchanger 3 or 2, is expressed by G, a discharge mass flow of high pressure gas refrigerant I discharged from the discharge port 29 at the compressor 1 becomes G+g, resulting in an increase of the discharge mass flow only by the injection mass flow g.

Hence, during the air-heating, the mass flow of refrigerant flowing through the indoor heat exchanger 2 for condensation, increases to raise the air-heating capacity. While, during the air-cooling, the injection pressure liquid refrigerant IV separated by the gas-liquid separator 6, as shown in FIG. 13, becomes a saturation liquid line to increase an evaporative latent heat by Δi, thereby achieving the air-cooling capacity increase.

When the compressor 1 is brought into a halt during the aforesaid operation of the refrigeration system, the open-close valve 58 is closed to automatically open the control valve 54 by function of the spring 55, so that the by-pass passage channel 53 is open to quickly equalize the pressure between high and low pressures, thus enabling a simple pressure equalizing by controlling the single open-close valve 58 without using any complex control device.

A capacity decrease operation of the system for a fixed time when starting, can relieve a starting load, which is also perfomable by closing one open-close valve 58 for a fixed time, thereby relieving the starting load without using a complex control device.

For the purpose of only relieving the starting load, there is no need of the above control of the open-close valve 58, in other words, when the system starts, it takes a certan time to raise an injection pressure within the gas-liquid separator 6 and lower a suction pressure, in which even when the open-close valve 58 opens, the spring 55 keeps the control valve 54 open until the injection pressure and suction pressure reach the predetermined value, thereby automatically relieving the starting load.

In lieu of a fixed blade compressor, as shown in FIGS. 1–10, a rotary blade type rotary compressor may be used for the refrigerant system of the invention. The rotary blade type rotary compressor, as shown in FIG. 11, has a cylinder chamber **64*a* formed at a cylinder body 64, the cylinder chamber 64*a* being shifted at the center thereof from the axis of rotation of the drive shaft; so that the drive shaft is provided with a rotor 65 concentric with the axis of the same, the rotor 65 slidably carrying two blades 66 and 67**.

Figure 11:
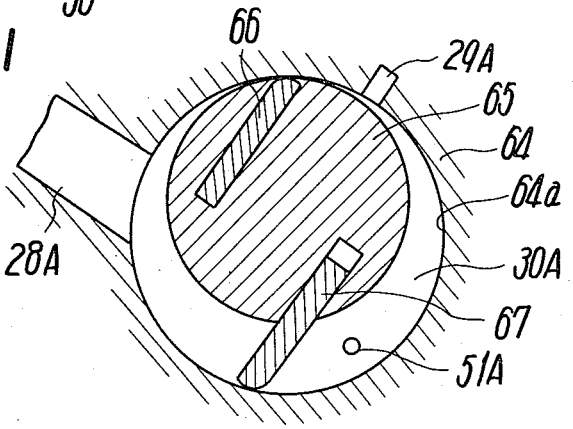
Figure 12:
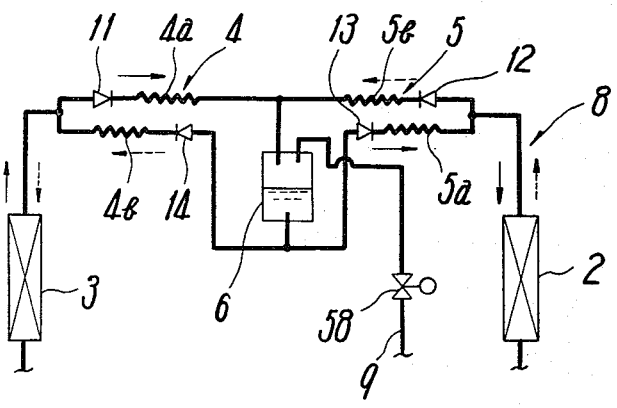

In this type of compressor, pumping chambers, as shown in FIG. 11, are formed between two blades 66 and 67 respectively, one pumping chamber 30A ending its suction-compression process at one and a half rotations of the rotor 65, i.e., at an angular position at 540° from the base point.

This type of compressor also has an injection pressure port 51A provided at an intermediate portion between the suction port 28A and the discharge port 29A. The rotor 65 does not rotate eccentrically as the rotor 23 in the former embodiment, but is constant in position, so that the injection pressure port 51A is positioned sufficiently to face the pumping chamber 30A. The compressor is set under other conditions similar to the compressor 1.

While the embodiments of the invention have been described using specific terms, such description is for illustrative purposes only, and it is to be understood that many changes and variations may be made without departing from the spirit or scope of the invention which is defined in the following claims.

What is claimed is:

1. A refrigeration system comprising a rotary compressor for compressing a low pressure refrigerant gas to a high pressure; a refrigeration pipe line system having a fluid input and fluid output respectively connected with a discharge port and a suction port of said compressor and further having therein a pair of heat exchangers; a pair of expansion mechanisms; a gas-liquid separator provided at an intermediate position between said expansion mechanisms; and a gas injection passage channel extending from a gas zone at said gas-liquid separator and connecting with an injection pressure port of said compressor; said compressor comprising a rotor and a cylinder block which has a cylinder chamber housing therein said rotor, said suction port and said discharge port being open at said cylinder chamber, and said injection pressure port opening at a pumping chamber between said suction port and said discharge port, said cylinder block being provided with a valve chamber communicating with said injection pressure port and with a by-pass passage channel extending from said valve chamber to a suction port side of said chamber, said valve chamber having a control valve for opening and closing a passage channel extending from said injection pressure port to said by-pass passage channel, a spring for biasing said control valve in the direction of being always open, and a back chamber at the rear side of said control valve, said control valve having a communicating aperture through which said back chamber communicates with said injection pressure port to permit the injection of an injection pressure gas from said injection pressure port to said pumping chamber, said gas injection passage channel communicating with said back chamber and having at an intermediate portion thereof an open-close valve which opens and closes said gas injection passage channel.

2. A refrigeration system according to claim 1, wherein said gas-liquid separator is interposed in position where a generating mass flow of injection pressure gas refrigerant generated by said gas-liquid separator becomes larger than an injection mass flow of gas refrigerant injected into said pumping chamber for a capacity increase, said communicating aperture having a diameter by which a passing mass flow of said injection pressure gas refrigerant passing through said communicating aperture becomes smaller than said gas generating mass flow at said gas-liquid separator.

3. A refrigeration system according to claim 1 or 2, wherein a sectional area of said by-pass passage channel and an passage channel extending from said injection pressure port to said by-pass passage channel through said valve chamber, is larger than a diameter of said communicating aperture at said control valve.

* * * * *